US005674655A

United States Patent [19]

Guistina et al.

[11] Patent Number: 5,674,655

[45] Date of Patent: Oct. 7, 1997

[54] ELECTROSTATOGRAPHIC TONERS CONTAINING METAL OXIDES

[75] Inventors: Robert A. Guistina, Rochester; Dinesh Tyagi, Fairport, both of N.Y.

[73] Assignee: Eastman Kodak Company, Rochester, N.Y.

[21] Appl. No.: 739,902

[22] Filed: Oct. 30, 1996

[51] Int. Cl.[6] ..... G03G 9/097

[52] U.S. Cl. ..... 430/106.6; 430/110

[58] Field of Search ..... 430/106.6, 110

[56] References Cited

U.S. PATENT DOCUMENTS

| | | | |
|---|---|---|---|
| 4,702,986 | 10/1987 | Imai et al. | 430/110 |
| 4,828,954 | 5/1989 | Hashimoto et al. | 430/110 |
| 5,212,037 | 5/1993 | Julien et al. | 430/110 |
| 5,248,581 | 9/1993 | Nakayama et al. | 430/106.6 |
| 5,275,905 | 1/1994 | Cicarelli et al. | 430/110 |
| 5,288,580 | 2/1994 | Julien et al. | 430/110 |
| 5,332,639 | 7/1994 | Nakamura et al. | 430/110 |
| 5,334,472 | 8/1994 | Aoki et al. | 430/110 |
| 5,406,357 | 4/1995 | Nakahara et al. | 430/904 |
| 5,510,220 | 4/1996 | Nash et al. | 430/110 |

*Primary Examiner*—Roland Martin
*Attorney, Agent, or Firm*—John R. Everett

[57] ABSTRACT

This invention comprises a toner particle comprising a polymeric binder and a metal oxide; wherein the metal oxide is blended throughout the polymeric binder.

9 Claims, No Drawings

ELECTROSTATOGRAPHIC TONERS CONTAINING METAL OXIDES

FIELD OF THE INVENTION

This invention relates to electrostatography, particularly toners for electrostatographic image development methods.

BACKGROUND OF THE INVENTION

In electrostatography, an image comprising a pattern of electrostatic potential (also referred to as an electrostatic latent image), is formed on a surface of an electrophotographic element and is then developed into a toner image by contacting the latent image with an electrographic developer. If desired, the latent image can be transferred to another surface following development. The toner image may be transferred to a receiver, to which it is fused, typically by heat and pressure.

Toners contain a binder and other additives, such as colorants. Electrostatographic toners are commonly made by polymerization of a binder followed by mixing with various additives and then grinding to a desired size range.

There are a number of toner binder characteristics which are influenced by its molecular weight and its architecture. For example, the molecular weight distribution and degree of branching directly affect melt viscosity, melt elasticity, toner keeping, photoconductor scumming, fusing and grinding characteristics. Therefore, it is desirable to control the molecular weight and molecular architecture of electrophotographic binder polymers quite precisely.

One of the most effective ways to achieve control over molecular weight and chain architecture is through the well-known use of mercaptan-type (RSH) chain-transfer agents which are added directly to the monomer mixture prior to initiation of the polymerization reaction. These types of chain-transfer agents possess high transfer coefficients (Cs) for styrene-based systems. They provide excellent control over polymer molecular weight and branching when they are used in conjunction with a crosslinking agent such as divinylbenzene.

The use of RSH-type chain-transfer agents suffers from a significant drawback. The mercaptan groups are incorporated into the polymer chains mainly as sulfide. In toner manufacture the binder polymers are subjected to high temperatures and shear resulting in degradation of the polymer molecular weight. This phenomenon leads to the regeneration of free thiol from the chain ends as well as other thiol-containing species. Some of these thermally-generated species are low enough in molecular weight to possess appreciable vapor pressures both at ambient tempertures and particularly when present in high-heat areas of electrophotographic copiers such as fusing stations.

Since these thiols and/or sulfide compounds have strong, objectionable odors typical of most sulfur compounds, their presence as impurity in the toner particles is not desirable. These sulfur compounds can have odor thresholds as low as 2 parts per billion. Additionally, these thermally-generated thiol compounds can further be oxidatively degraded to yield sulfur dioxide ($SO_2$) which is a highly volatile, malodorous gas.

Thus, in order to produce a low-odor toner with molecular architecture control through mercaptan-mediated chain-transfer it is necessary to obviate the presence of the low molecular weight mercaptans as well as their oxidation products. Since odor thresholds are very low for these compounds (2 ppb) it is difficult, if not impossible, to achieve odor-free polymer by convention purification methods, e.g., washings, slurrying, vacuum stripping etc.

SUMMARY OF THE INVENTION

The present invention provides toner particles comprising a vinyl polymeric binder containing (a) thiol or sulfide groups and (b) a metal oxide; provided the metal oxide is blended throughout the polymeric binder and the metal oxide is present in an amount ranging from 0.5 to 10.0 percent by weight of the toner.

The toner provides electrostatographic developers comprising the toners with carriers.

The toners and developers comprising the toners exhibit substanially reduced thiol and/or sulfide odors.

DETAILS OF THE INVENTION

The toner of the invention comprises a polymeric binder, a metal oxide, and optionally other useful additives described hereinafter.

A number of different metal oxide additives are useful in reducing the toner odor problem described above. Based on the examples presented herein and the chemical reactions involved we fully expect the following metal oxides to be useful: $Ag_2O$, CuO, CaO, ZnO, SnO, $Hg_2O$, HgO, CoO, NiO, CdO, PbO, $PbO_2$, SrO, BaO, FeO, $Fe_2O_3$, $Fe_3O_4$, $Al_2O_3$, MnO, VO, $V_2O_5$ and $VO_2$. Of these $Ag_2O$, CuO, CaO, ZnO and SnO are preferred.

The desired polymeric binder for toner application is first produced. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt blending of toner addenda, including the metal oxide, into the bulk of the polymer.

The polymer is made using a limited coalescence reaction. "Limited coalescence" is a relatively broad term that refers to both emulsion and suspension polymerizations.

The polymers used in the examples of this invention were prepared using the suspension polymerization procedure disclosed in U.S. Pat. No. 4,912,009 to Amering et al. The water insoluble reactants: monomer, crosslinker, initiator and chain transfer agent are mixed together and then dispersed into an aqueous medium containing a water-dispersible, but water-insoluble suspending agent.

The suspending agent or stabilizer is a negatively charged, solid colloidal material such as clay or colloidal silica. The suspending agent is used with a water soluble "promoter" that affects the hydrophobic-hydrophilic balance of the solid colloidal particles by forming a complex with the suspending agent. The promoter has both hydrophilic and hydrophobic groups and reduces the hydrophilicity of the suspending agent. As stated in U.S. Pat. Nos. 2,932,629 to Wiley et al, the promoter drives the particle of the solid colloid to the liquid-liquid interface of the oleophilic monomer droplets and the aqueous phase.

The colloidal particles have dimensions from about 1 to 100 nanometers and preferably from about 5 to 70 nanometers. The size and concentration of these particles largely controls the size of the polymer particles.

Hydrophilic colloidal silica useful as the suspending agent is available commercially, for example, under the trade names and in the particle sizes as follows: LUDOX TM, 20 nm; LUDOX HS-40, 12 nm; LUDOX SM, 7 nm; and LUDOX AM, 12 nm; all supplied by E. I. du Pont de Nemours Company; and NALCOAG 1060, 60 nm supplied by Nalco Chemical Co.

A material useful as the promoter is a condensation product of about 2 to 6 carbon alkyl dicarboxylic acid and an alkanol amine. A current preferred diacid is adipic acid. It is currently preferred that the alkanol groups of the alkanol amine have from about 1 to 4 carbons. Particularly preferred are diethanolamine and methyl amino ethanol. With adipic acid, these form polymers that complex with hydrophobic silica and then coat the hydrophilic droplets.

It is also desirable that a water soluble material be added that prevents polymerization in the aqueous phase. Examples of such materials are: sodium nitrate, copper salts, methylene blue, and phenols. A currently preferred material is potassium dichromate.

The free radical initiator is soluble in the mixture of monomer, crosslinker, and chain transfer agent. Examples of such initiators include azo compounds such as 2,2'-azobis (2-methylbutyronitrile), 2,2'-azobis(isobutyronitrile). Commercially available products include: VAZO 67, VAZO 64, and VAZO 52 marketed by du Pont.

In a particular embodiment of the method of the invention, the monomer, crosslinker, chain transfer agent, and initiator are first combined to provide an initial reaction mixture which is then added to an aqueous dispersion of the stabilizing agents. The initial reaction mixture is added to the aqueous mixture with high shearing agitation to a obtain a suspension of monomer droplets. The high shearing forces reduce the size of the monomer droplets. An equilibrium is reached in which the size of the droplets is stabilized or limited by the suspending agent complex which coats the surfaces of the droplets.

The mixture is then heated and stirred in the reaction vessel to polymerize the monomer droplets. The resulting polymer beads are isolated by filtration and can, if desired, be slurried with water to remove water-soluble impurities and free suspending agent complex. No extensive washing or other purification is needed.

The polymer is the polymerization product of vinyl type monomer, crosslinker, and chain transfer agent. The relative concentrations of crosslinker and chain transfer agent can be varied over a considerable range as discussed below; however, there are minimum concentrations of these two ingredients in the particulates of the invention. The crosslinker has a concentration, in the reaction mixture and the polymer produced, greater than about 0.2 parts by weight per 100 parts by weight of the monomer. The total concentration of both crosslinker and chain transfer agent is greater than about 0.4 parts by weight per hundred parts of monomer. Unless crosslinker and chain transfer agent are at these concentrations or higher, characteristics of the particulate produced, such as degree of branching and/or gel concentration, varies widely with small changes in concentration of crosslinker or chain transfer agent or equipment size or conditions. These very narrow tolerances are unacceptable for manufacturing scale processes can destroy or greatly diminish the practical usefulness of such materials. In currently preferred embodiments of the invention, having greater tolerances for concentration inaccuracies, the crosslinker has a concentration of at least 0.2 parts per hundred parts of monomer and the chain transfer agent has a concentration of at least 0.2 parts per hundred parts of monomer.

Certain monomers are preferred, namely styrene and butyl acrylate. Examples of other suitable monomers include styrene, alpha-methylstyrene, parachlorostyrene, and vinyl toluene; and an alkyl acrylate or mathacrylate or monocarboxylic acids having a double bond is selected from the group consisting of acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methacrylic acid, methyl methacrylate, ethyl methacrylate, butyl methacrylate and octyl methacrylate.

In a currently preferred embodiment the largest component of the monomer composition is styrene or a styrene homologue such as methyl styrene. It is preferred that the styrene monomer is used in an amount of at least about 60 weight percent and more preferably at least about 75 weight percent of the monomer composition. The composition also contains at least one alkyl acrylate or methacrylate. Preferably, this is a lower alkyl acrylate or methacrylate, in which the alkyl group contains from 1 to about 4 carbon atoms.

The crosslinker contains one or more compounds each having two or more double bonds capable of polymerization. Examples of suitable crosslinkers include: aromatic divinyl compounds such as divinyl benzene, and divinyl naphthalene; carboxylic acid esters having two double bonds such as ethylene glycol diacrylate, ethylene glycol dimethacrylate, and 1,3-butane diol dimethylacrylate; divinyl compounds such as divinyl aniline, divinyl ether, divinyl sulfide, and divinyl sulfone; and compounds having three or more vinyl groups.

The chain transfer agent acts a chain terminator in the polymerization process. Suitable chain transfer agents include: mercaptans such as t-dodecanethiol, laurylmercaptan, and butylmercaptan.

Binder materials that are useful in the toner particles used in the method of this invention can be amorphous or semicrystalline polymers. The amorphous toner binder compositions would have a Tg in the range of about 45° C. to 120° C., and often about 50° C. to 70° C. The useful semi-crystalline polymers would have a Tm in the range of about 50° to 150° C. and more preferably between 60° C. and 125° C. Such polymers can be heat-fixed to a film supports as well as to more conventional substrates, such as paper, without difficulty. The thermal characteristics, such as Tg and Tm, can be determined by any conventional method, e.g., differential scanning calorimetry (DSC).

An optional but preferred component of the toner is colorant: a pigment or dye. Suitable dyes and pigments are disclosed, for example, in U.S. Pat. No. Re. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

Another component of the toner composition is a charge control agent. The term "charge control" refers to a propensity of a toner addendum to modify the triboelectric charging properties of the resulting toner. A very wide variety of charge control agents for positive charging toners are available. A large, but lesser number of charge control agents for negative charging toners is also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

The toner can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis.

Dry styrenic/acrylic copolymer toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The compositions of the invention are prepared by blending the binder resin, the elastomeric thermoplastic additive and any other toner addenda or components before forming the toner particles. For example, the components are first melt-blended and then solidified, crushed and ground. The preferred method comprises melt-blending a fusible toner binder resin with a pigment, a charge-control agent and a suitable metal oxide of the present invention. The blend is solidified, crushed and microground to the desired particle size.

Melt blending can be accomplished using a roll mill or an extruder at temperatures of 100° C. to 240° C., preferably 120° C. to 180° C., in a period of 30 minutes or less. After cooling, the polymer composition is crushed or pulverized and then ground to the desired small particle size using a fluid energy or jet mill. The purpose of crushing and grinding the modified toner composition of the present invention is to reduce it to the form of finely divided particles or powder. Particles having an average diameter of from about 5 to 20 micrometers are preferred and those having an average diameter of 6 to 12 micrometers are even more preferred. Conventional particle classification techniques are then used to achieve a toner particle composition having a desired particle size distribution.

The toner of the invention can be used in single component developers (in which carrier particles are not present) or in dual component developers incorporating carrier particles. So far as is now known, the toner particles can be used in all known electrostatographic copying processes.

The carrier can be any of a variety of conductive materials; for example: particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571.

Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; and 4,546,060.

Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See for example, U.S. Pat. Nos. 4,545,060; 4,478,925; 4,076,857; and 3,970,571; and 4,726,994. Polymeric fluorocarbon coatings can aid the developer to meet the electrostatic force requirements mentioned above by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles. Currently preferred is a mixture of poly(vinlyidene fluoride) and poly(methyl methacrylate) as described for example in U.S. Pat. Nos. 4,590,140; 4,209,550; 4,297,427 and 4,937,166.

The carrier can be strontium ferrite coated with fluorocarbon on a 0.5 percent weight/weight basis, and treated with an aqueous solution of 4 weight percent KOH and 4 weight percent of a 2 parts by weight to 1 parts by weight mixture of $Na_2S_2O_8$ and $Na_2S_2O_5$ as disclosed in U.S. patent application Ser. No. 08/127,382, filed Sep. 24, 1993, by William E. Yoerger, which is hereby incorporated herein by reference. The fluorocarbon carrier is also referred to as "modified Kynar®". In a preferred embodiment, the carrier is sponge iron, which is sieved, oxidized and coated with fluorocarbon on a 0.2 weight percent basis.

In a particular embodiment, the developer of the invention contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

The developer of the invention can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After image-wise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

The following Examples are presented to further illustrate some preferred modes of the invention. Unless otherwise indicated, all starting materials were commercially obtained.

EXAMPLES 1–5

Toners were prepared with various metal oxides, binder polymer and colorant according to the following formulation:

| | |
|---|---|
| Binder Polymer | 47 grams |
| Black Pearls 430 Carbon | 3 grams |
| Metal Oxide | 1 grams |
| Charge control agent: Dodecylbenzyldimethyl ammonium 3-nitrobenzenesulfonate | 0.5 grams |

The above binder polymer was polymerised by using 80 grams of styrene monomer, 20 grams of butyl acrylate monomer, 1.0 gram of divinyl benezene cross-linker and 1.9 grams of t-dodecanethiol as the chain transfer agent.

The different metal oxides used in separate toner formulations were:

| TONER EXAMPLE | METAL OXIDE ADDITIVE |
|---|---|
| Comparatieve 1 | None (Control) |
| Example 1 | Silver Oxide ($Ag_2O$) |
| Example 2 | Copper Oxide (CuO) |
| Example 3 | Calcium Oxide (CaO) |
| Example 4 | Zinc Oxide (ZnO) |
| Example 5 | Tin Oxide (SnO) |

The toner formulation was melt compounded at 150° C. on a 4-inch (10.16 cm) two-roll mill for 20 minutes. The melt slab was then removed from the rolls and coarse ground using a Wiley mill and finally pulverized in a TX fluid energy mill to yield a mean toner particle size of approximately 12 μm.

The toner was first allowed to stand undisturbed for 2 days in a capped toner bottle. The perception of sulfur or thiol-type odor was measured by sniffing the headspace over the toner immediately upon opening the toner bottle. In a related experiment, two grams of the test toner in a capped 8 oz bottle was heated to 230° C. on a hot plate for two minutes. The bottle was taken from the hot plate but before cooling significantly the cap of the bottle was removed and the resulting odor of the emitted vapor was noted by careful sniffing. The perceived level of odor was recorded.

Results from the odor testing of toner formulations with and without the inclusion of the metal oxides discussed above are summarized in the following table.

| SAMPLE | ADDITIVE | ODOR RESPONSE |
|---|---|---|
| Control | NONE | Very strong mercaptan |
| 1. | 1 pph Silver Oxide | No mercaptan |
| 2. | 1 pph Zinc Oxide | Slight Mercaptan |
| 3. | 1 pph Cupric Oxide | No Mercaptan |
| 4. | 1 pph Calcium Oxide | Slight Mercaptan |
| 5. | 1 pph Tin Oxide | No Mercaptan |

As indicated above there is considerable reduction in the sulfide and/or thiol type odor response from the toner formulations containing the metal oxide additives. The level of odor reduction is obviously dependent upon the specific metal oxide used and the concentration of thiol and/or sulfide present in a given toner formulation. The improvement in mercaptan odor response with the use of metal oxides is unmistakable.

Many other metal oxides can also be envisioned to have desirable activity in the subject application since they also form highly-insoluble mercaptide salts. Examples may include, but are not restricted to $Hg_2O$, HgO, CoO, NiO, CdO, PbO, $PbO_2$, SrO, BaO, FeO, $Fe_2O_3$, $Fe_3O_4$, $Al_2O_3$, MnO, VO, $V_2O_5$ and $VO_2$. Of these $Ag_2O$, CuO, CaO, ZnO and SnO are preferred.

EXAMPLES 6–13

The test performed in examples 1–5 was carried out with the following binder and metal oxides.

| Binder polymer composition | |
|---|---|
| Styrene | 80 grams |
| Butyl Acrylate | 20 grams |
| Divinyl Benzene | 0.7 grams |
| t-dodecanethiol | 0.75 grams |

| Metal oxides |
|---|
| – Silver oxide |
| – Tin oxide |
| – Zinc oxide |
| – Calcium oxide |

Toners were prepared exactly as in Example 1–5 except the polymeric binder decribed above was used with 1 pph and 2 pph of above metal oxides. The presence of the metal oxides used in these examples reduced the mercaptan odor in a manner similar to in Examples 1–5.

This invention has been described with particular reference to preferred embodiments thereof but it will be understood that modifications can be made within the spirit and scope of the invention.

We claim:

1. A toner particle comprising a vinyl polymeric binder containing (a) thiol or sulfide groups and (b) a metal oxide; provided the metal oxide is blended throughout the polymeric binder and the metal oxide is present in an amount ranging from 0.5 to 10.0 percent by weight of the toner.

2. The toner of claim 1 wherein the polymeric binder comprises styrene and an alkyl acrylate or methacrylate and the styrene content is at least 60 weight percent and the metal oxide is selected from the group consisting of $Ag_2O$, CuO, CaO, ZnO, SnO, $Hg_2O$, HgO, CoO, NiO, CdO, PbO, $PbO_2$, SrO, BaO, FeO, $Fe_2O_3$, $Fe_3O_4$, $Al_2O_3$, MnO, VO, $V_2O_5$ and $VO_2$.

3. The toner of claim 2 wherein the metal oxide is selected from the group consisting of $Ag_2O$, CuO, CaO, ZnO and SnO.

4. The toner of claim 2 also containing a charge control agent and a colorant.

5. The toner of claim 2 wherein styrene is selected from the group consisting of styrene, alpha-methylstyrene, para-chlorostyrene, and vinyl toluene; and an alkyl acrylate or mathacrylate or monocarboxylic acids having a double bond is selected from the group consisting of acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methacrylic acid, methyl methacrylate, ethyl methacrylate, butyl methacrylate and octyl methacrylate.

6. The toner of claim 1 wherein the polymeric binder comprises styrene, divinyl benezene and butyl acrylate; and the metal oxide is selected from the group consisting of $Ag_2O$, CuO, CaO, ZnO and SnO.

7. The toner of claim 1 comprising from 1.0 to 5.0 percent by weight of the metal oxide.

8. The toner of claim 1 having a cross-linked polymeric binder.

9. An electrostatographic developer comprising a carrier and a toner according to any one of claims 1–8.

* * * * *